US009824556B2

(12) United States Patent
Zacchio et al.

(10) Patent No.: US 9,824,556 B2
(45) Date of Patent: Nov. 21, 2017

(54) SECURITY SENSOR

(71) Applicant: Carrier Corporation, Farmington, CT (US)

(72) Inventors: Joseph Zacchio, Wethersfield, CT (US); Nicholas Charles Soldner, Mountainview, CA (US)

(73) Assignee: Carrier Corporation, Jupiter, FL (US)

( * ) Notice: Subject to any disclaimer, the term of this patent is extended or adjusted under 35 U.S.C. 154(b) by 0 days.

(21) Appl. No.: 15/179,083

(22) Filed: Jun. 10, 2016

(65) Prior Publication Data

US 2017/0004686 A1 Jan. 5, 2017

Related U.S. Application Data

(60) Provisional application No. 62/186,687, filed on Jun. 30, 2015.

(51) Int. Cl.
*G08B 13/06* (2006.01)
*G08B 29/04* (2006.01)

(52) U.S. Cl.
CPC ..... *G08B 13/06* (2013.01); *G08B 29/046* (2013.01)

(58) Field of Classification Search
CPC ..... G08B 13/128; G08B 29/046; G08B 13/19697; G08B 29/04; G08B 13/1436; G08B 15/001; G08B 13/193; G08B 13/126
See application file for complete search history.

(56) References Cited

U.S. PATENT DOCUMENTS 5,870,022 A * 2/1999 Kuhnly ..... G08B 29/26 340/511
6,469,625 B1 * 10/2002 Tomooka ..... G08B 29/046 250/342
6,529,129 B1 * 3/2003 Tomooka ..... G08B 29/046 250/341.8
2001/0041535 A1 * 11/2001 Karmel ..... G01S 5/0027 455/12.1
2006/0197658 A1 * 9/2006 Light ..... G08B 13/1427 340/539.23
2010/0283611 A1 * 11/2010 Smith ..... G08B 13/126 340/568.1
2012/0098663 A1 * 4/2012 Zhou ..... B60R 25/00 340/568.1
2013/0222172 A1 * 8/2013 Sentelle ..... G01S 13/88 342/22
2017/0004686 A1 * 1/2017 Zacchio ..... G08B 13/06

* cited by examiner

*Primary Examiner* — An T Nguyen
(74) *Attorney, Agent, or Firm* — Ice Miller LLP

(57) ABSTRACT

A security sensor including a processor, communication module, antenna, and tamper detection circuit, wherein the sensor is configured to detect tampering based at least in part on a difference between an electrical characteristic of a first signal and the electrical characteristic of a second signal.

12 Claims, 3 Drawing Sheets

SECURITY SENSOR

CROSS REFERENCE TO RELATED APPLICATIONS

The present application is related to, and claims the priority benefit of, U.S. Provisional Patent Application Ser. No. 62/186,687 filed Jun. 30, 2015, the contents of which are hereby incorporated in their entirety into the present disclosure.

TECHNICAL FIELD OF THE DISCLOSED EMBODIMENTS

The presently disclosed embodiments are generally related to security systems; and more particularly to a security sensor.

BACKGROUND OF THE DISCLOSED EMBODIMENTS

Security systems commonly employ momentary sensors to detect when someone or something is attempting to gain access to the interior, tamper with the sensor, and/or disable the device. Most security systems commonly employ tamper switches for detecting when the cover of the sensor has been opened, or that the sensor enclosure has been removed from the fixed structure to which it was attached. A typical tamper switch includes a pair of contacts that may be opened or closed as a result of the sensor enclosure being opened, or as a result of the sensor enclosure being removed from the fixed structure. Security systems also contain antennas for communications to the user or the other security personnel. Generally, these components are separate systems; thus, increasing the cost of the system. Accordingly, there exists a need for a more cost effective security sensor.

SUMMARY OF THE DISCLOSED EMBODIMENTS

In one aspect, a security system is provided. The security system includes one or more sensors, and a control unit. In some embodiments, the security system further includes a monitoring system, and a remote activation system. Communication links operably couple the sensors to control unit. In some embodiments, the sensors and control unit are located in the same facility. In other embodiments, communication links may couple the control unit to the monitoring system. In certain embodiments, the monitoring system may communicate with multiple control units belonging to other security systems.

In certain embodiments, one or more of the sensors may monitor conditions other than security-related conditions. Control unit may include a sensor monitoring module, a user interface, and an alarm module. Sensor monitoring module may be configured to monitor sensors. Sensors may sense and/or indicate a change in their physical surroundings which may be indicative of an unauthorized access, fire, or other event.

In one aspect, a sensor is provided. The sensor include a processor, a communication module in communication with the processor, an antenna operably coupled to the communication module, and a tamper detection circuit in communication with the processor, each disposed within a housing. Communication module and antenna are used for communication with the control unit. Tamper detection circuit is configured to detect the presence of a foreign object in close proximity to the housing based in part on the change in energy radiating from the antenna.

In another aspect, a method for detecting unauthorized tampering with the sensors is provided. The method includes the step of transmitting a first signal.

The method further includes the step of measuring a first electrical characteristic of the first signal. In an embodiment, the first electrical characteristic includes a voltage.

The method further includes the steps of generating a second signal when an object is in close proximity to the sensor, and measuring a second electrical characteristic of the second signal. In an embodiment, the second electrical characteristic includes a voltage The method proceeds to the step of determining whether a difference between the first electrical characteristic and the second electrical characteristic is greater than or equal to a tamper threshold. In an embodiment, the tamper threshold is adjustable. In another embodiment, the tamper threshold is adjustable based at least in part on at least one environmental factor. In another embodiment, the method generates an alarm signal if the difference between the first electrical characteristic the second electrical characteristic is greater than or equal to a tamper threshold.

DETAILED DESCRIPTION OF THE DISCLOSED EMBODIMENTS

Figure 1:
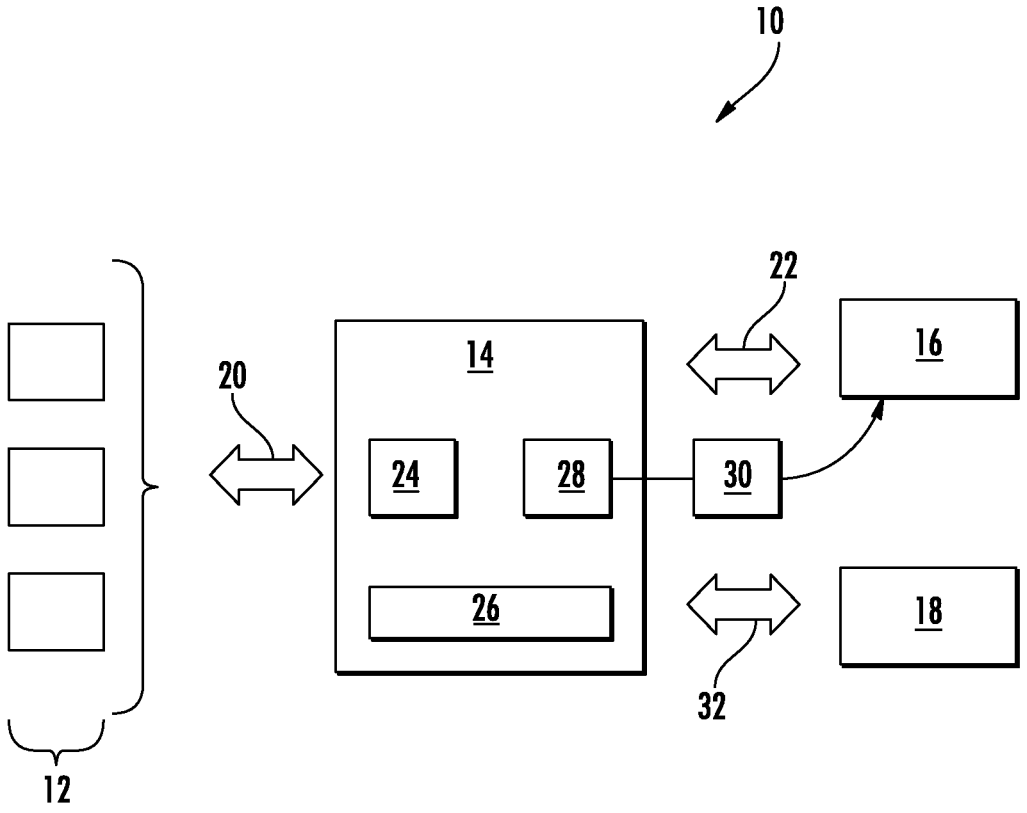
FIG. 1 illustrates a schematic diagram of a security system according to one embodiment of the present disclosure.

For the purposes of promoting an understanding of the principles of the present disclosure, reference will now be made to the embodiments illustrated in the drawings, and specific language will be used to describe the same. It will nevertheless be understood that no limitation of the scope of this disclosure is thereby intended.

FIG. 1 illustrates an embodiment of a security system, generally indicated at 10, which may also be referred to as an "alarm system." The security system 10 includes one or more sensors 12 (also referred to as security sensors), and a control unit 14. In some embodiments, the security system 10 further includes a monitoring system 16, and a remote activation system 18. Communication links 20 (which may be a combination of wired and wireless communication links) operably couple sensors 12 to control unit 14. Wired communication links can include circuit loops that are either detected as closed or open. In some embodiments, sensors 12 and control unit 14 are located in the same facility, such as in the same residence or in the same building. In other embodiments, communication link 22 (which may be a wired telephone connection, wired or wireless network connection, cellular connection, etc., or combination thereof) may couple the control unit 14 to the monitoring system 16. In certain embodiments, the monitoring system 16 may communicate with multiple control units 14 belonging to other security systems.

Sensors 12 monitor for certain events and report relevant events to the control unit 14. Sensors 12 may include any of a variety of different types of sensors, such as door and window sensors, motion sensors, glass break sensors (e.g., sensors that detect a physical break or detect the sound of a glass break), etc. The control unit 14 may be configured to monitor sensors 12 for alarm conditions via communication links 20 and to relay alarms to the monitoring system 16 via communication link 22. The sensors 12 may, in response to detecting an alarm condition, send an alarm condition message to the control unit 14.

In certain embodiments, one or more of the sensors 12 may monitor conditions other than security-related conditions. For example, one or more sensors 12 may monitor energy usage within the home, temperature, ambient light levels, and other conditions. The control unit 14 may receive the measurements from the sensors 12 and provide them to the user of the system or use them in providing building automation services.

Control unit 14 may include a sensor monitoring module 24, a user interface 26, and an alarm module 28. Sensor monitoring module 24 may be configured to monitor sensors 12. Sensors 12 may sense and/or indicate a change in their physical surroundings (e.g., tampering with the sensor, a normally closed connection becomes open, a signal indicating the sound of breaking glass was detected, etc.) which may be indicative of an unauthorized access, fire, or other event. The sensors 12 may communicate messages on communication links 20. For example, a circuit connected to a door sensor may transition from closed to open (or to a resistance exceeding a pre-determined resistance threshold) indicating a door has been opened. A motion sensor may send an electrical signal indicative of the detected motion. Sensor monitoring module 24 may monitor communication links 20 for alarm condition messages sent from sensors 12. Upon sensor monitoring module 24 receiving an alarm condition message signaling the occurrence of an alarm condition, sensor monitoring module 24 may send a signal to alarm module 28.

The alarm module 28 may validate the alarm condition has occurred before communicating with the monitoring system 16 or generating an alarm using the alarm 30. For example, the alarm module 28 may validate an alarm condition that indicates a window is open when the security system is on, but may not validate the same alarm condition when the security system is off.

The alarm module 28 may cause an alarm 30 to generate an alarm in response to validating the alarm condition. The alarm 30 may provide an audio signal (such as beeping, audio instructions, or other suitable audio), a visual signal (such as a flashing light) or a combination thereof to alert a user to the alarm condition. Where the control unit 14 is associated with one or more controllers providing building automation features, the control unit 14 may also use those features to provide an alarm. For example, the control unit 14 may flash one or more interior lights as part of the alarm.

User interface 26 may include an input interface and an output interface. The input interface may comprise a physical input interface or virtual input interface that may include a numeric key pad (e.g., for entering a disarm code, etc.), sensor activation buttons, physical duress buttons, or other input/output devices. The input interface may include a device for receiving audio input and/or communicating with monitoring system 16. The output interface may include an output display device that displays system status, such as armed and disarmed, sensors/zones that have detected change in physical surroundings, and other relevant information. The output interface may also include a speaker that audibly outputs information similar to that displayed on the output display device. The speaker may also be used by monitoring system 16 to communicate with a user of control unit 14. Other input/output approaches may also be implemented as part of the user interface 26.

The control unit 14 may also communicate over a communication link 32 with the remote activation system 18. The remote activation system 18 may allow a user to interact with the control unit 14 remotely. For example, the user may be able to arm and disarm the security system 10 from a mobile device such as a cellular phone using the remote activation system 18. It will be appreciated that the remote activation system 18 may include software installed on the mobile device of the user.

Figure 2:
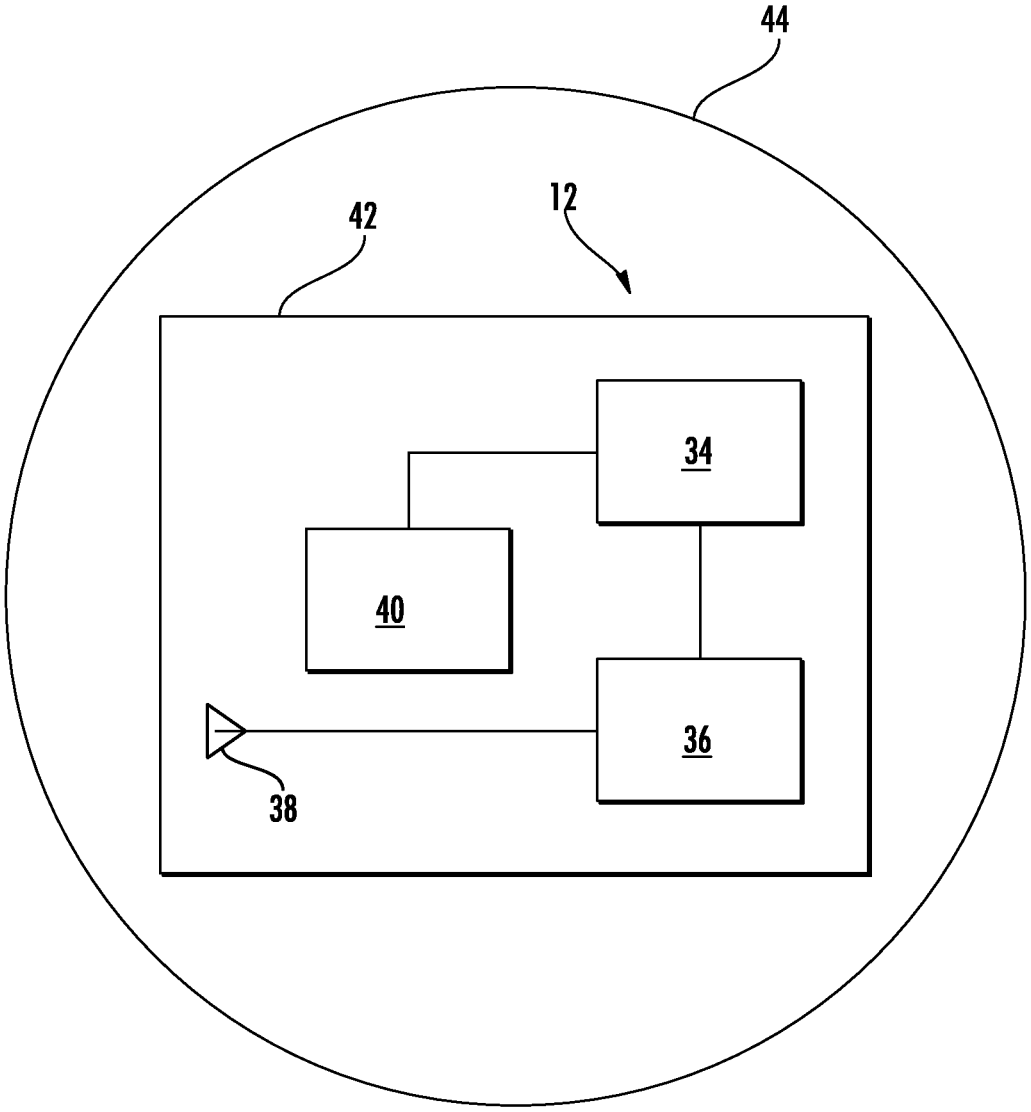
FIG. 2 illustrates a schematic diagram of a security sensor according to one embodiment of the present disclosure.

FIG. 2 illustrates an embodiment of a sensor 12. The sensor 12 includes a processor 34, a communication module 36 in communication with the processor 34, an antenna 38 operably coupled to the communication module 36, and a tamper detection circuit 40 in communication with the processor 34, each disposed within a housing 42. Sensor 12 may also implement a compiler (not shown) which may allow one or more application programs (not shown) written in a programming language to be translated into processor-readable code. Instructions implementing an application program may be tangibly embodied in a computer-readable medium. Further, an application program may include instructions which, when read and executed by processor 34, may cause processor 34 to perform the steps necessary to implement and/or use embodiments of the present disclosure. Communication module 36 and antenna 38 are used for communication with the control unit 14. It will be appreciated that communication module 36 may be a radio-frequency (RF) communication module that facilitates radio communication to name one non-limiting example. Tamper detection circuit 40 is configured to detect the presence of a foreign object, such as a human hand to name one non-limiting example, in close proximity to the housing 42 based in part on the change in energy radiating from the antenna 38.

Figure 3:
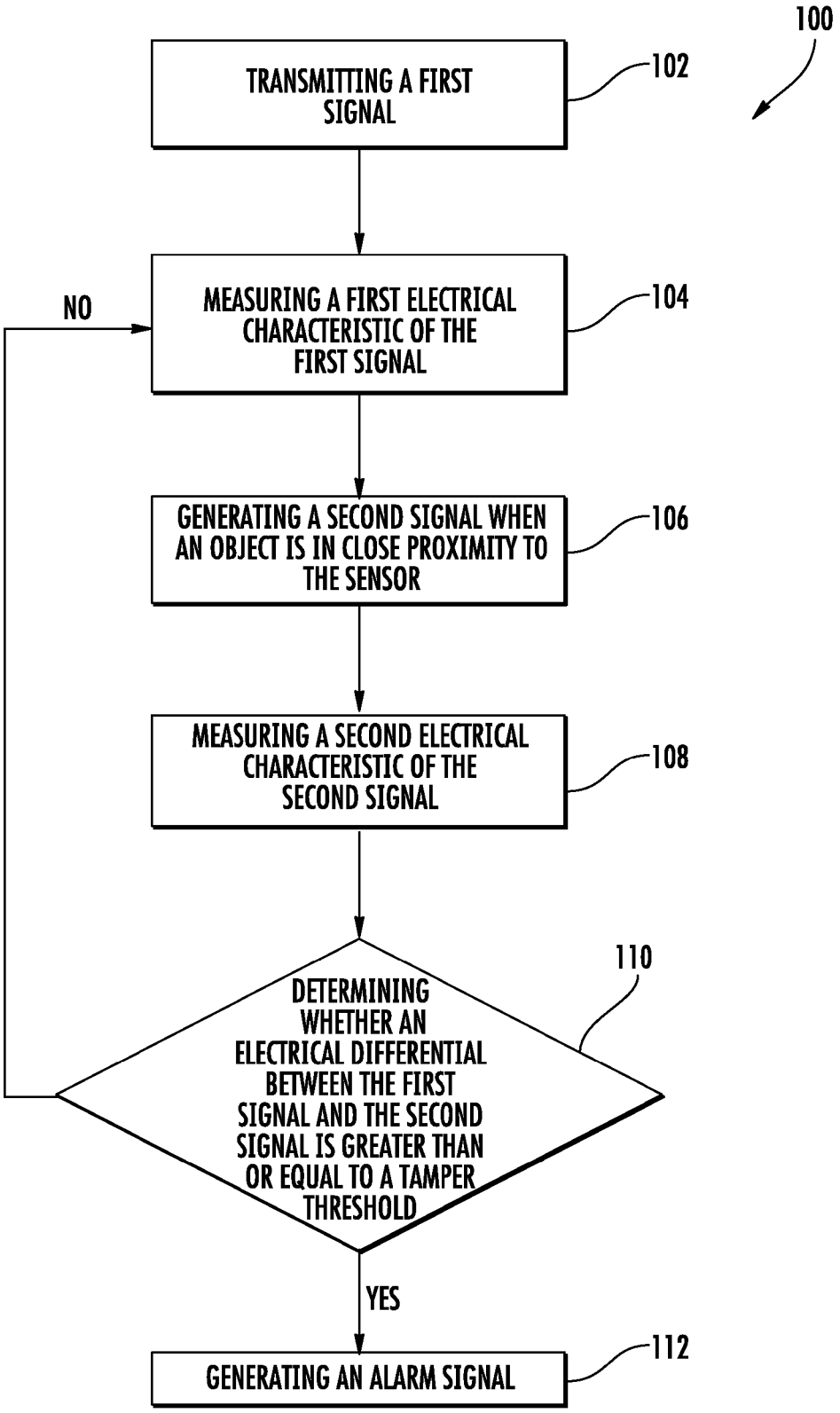
FIG. 3 illustrates a schematic flow diagram of a method for detecting unauthorized tampering with a security sensor.

FIG. 3 illustrates a schematic diagram of a method for detecting unauthorized tampering with the sensors 12, the method generally indicated at 100. The methods includes step 102 of operating the antenna 38 to transmit a first signal. For example, with reference to FIGS. 1 and 2, the communication module 36 and the antenna 38 work in concert to transmit status signals to the control unit 14. As the sensor 12 transmits the status signal to the control unit 14, current flows through the antenna 38 to radiate an electromagnetic field 44. This electromagnetic field expands outward from the sensor 12.

The method further includes step 104 of operating the detection circuit 40 to measure an first electrical characteristic of the first signal. In an embodiment, the first electrical characteristic includes a voltage. For example, as the communication module 36 and the antenna 38 transmit status signals to the control unit 14, the detection circuit 40 may measure the voltage of the status signals.

The method further includes step 106 of operating the detection circuit 40 to generate a second signal when an object is in close proximity to the sensor 12. For example, when an object, for example a human hand, is in close proximity to the sensor 12, the electrical characteristics of the antenna 38 are modified; thus, a second (i.e. modified) signal is generated by the detection circuit 40.

The method 100 further includes step 108 of operating the detection circuit 40 to measure an second electrical characteristic of the second signal. In an embodiment, the second electrical characteristic includes a voltage. For example, the processor 34 periodically operates the detection circuit 40 to take samples of the voltage generated by the status signal and the modified signal. It will be appreciated that the processor 34 may continuously operate the detection circuit 40 to take samples.

The method proceeds to step 110 of operating the processor 34 to determine whether a difference between the first electrical characteristic and the second electrical characteristic is greater than or equal to a tamper threshold. In an embodiment, the tamper threshold is adjustable. In another embodiment, the tamper threshold is adjustable based at least in part on at least one environmental factor. For example, the tamper threshold may be adjustable based upon materials surrounding, and temperatures near, the sensor 12 to name a couple of non-limiting factors.

Continuing with the example, the processor 34 may take the voltage differential between the status signal and the modified signal, then compare the difference with the tamper threshold. If the difference between the first electrical characteristic and the second electrical characteristic is greater than or equal to a tamper threshold, then the processor determines that an object is too close to the sensor 12; thus, it is likely that that someone is tampering with the sensor 12. It will be appreciated that the sensor 12 may include a differential sensor disposed therein to sense the voltage change of the status signal and the modified signal.

If the difference between the electrical first characteristic and the second electrical characteristic is greater than or equal to the tamper threshold, the method proceeds to step 112 of generating an alarm signal, wherein the alarm signal is indicative of tampering with the sensor 12.

It will therefore be appreciated that the present embodiments include a security sensor 12 that is configured to determine whether tampering is occurring without the need of a separate tamper switch by measuring the differential between a signal transmitted by the antenna 38 and signal generated by detection circuit 40.

While the invention has been illustrated and described in detail in the drawings and foregoing description, the same is to be considered as illustrative and not restrictive in character, it being understood that only certain embodiments have been shown and described and that all changes and modifications that come within the spirit of the invention are desired to be protected.

What is claimed is:

1. A method for detecting unauthorized tampering with a security sensor including a processor, an antenna and a detection circuit, the method comprising the steps:

(a) transmitting a first signal;

(b) measuring a first electrical characteristic of the first signal;

(c) generating a second signal when an object is in close proximity to the sensor;

(d) measuring a second electrical characteristic of the second signal;

(e) determining whether a difference between the first electrical characteristic and the second electrical characteristic is greater than or equal to a tamper threshold; and (f) generating an alarm signal subsequent to determining the difference between the first electrical characteristic the second electrical characteristic is greater than or equal to a tamper threshold.

2. The method of claim 1, wherein the first electrical characteristic and the second electrical characteristic comprise a voltage.

3. The method of claim 1, wherein the tamper threshold is adjustable.

4. The method of claim 3, wherein the tamper threshold is adjustable based at least in part on at least one environmental factor.

5. A security sensor comprising:

a processor;

a communication module in electrical communication with the processor, the communication module configured to transmit a first signal;

an antenna in communication with the communication module; and a tamper detection circuit in communication with the processor, the tamper detection circuit configured to generate a second signal and measure a first electrical characteristic of the first signal and a second electrical characteristic of the second signal;

wherein the processor is configured to determine whether the difference between the first electrical characteristic and the second electrical characteristic is greater than or equal to a tamper threshold and generate an alarm signal subsequent to having determined the difference between the first electrical characteristic and the second electrical characteristic is greater than or equal to a tamper threshold.

6. The sensor of claim 5, wherein the first electrical characteristic and the second electrical characteristic comprise a voltage.

7. The sensor of claim 5, wherein the tamper threshold is adjustable.

8. The sensor of claim 7, wherein the tamper threshold is adjustable based at least in part on at least one environmental factor.

9. A security system comprising:

a control unit; and at least one sensor in communication with the control unit;

wherein the at least one sensor is configured to:

transmit a first signal;

generate a second signal; and measure a first electrical characteristic of the transmitted first signal and a second electrical characteristic of the generated second signal;

determine whether the difference between the first electrical characteristic and the second electrical characteristic is greater than or equal to a tamper threshold; and transmit an alarm signal to the control unit if the difference between the first electrical characteristic and the second electrical characteristic is greater than or equal to a tamper threshold.

10. The security system of claim 9, wherein the first electrical characteristic and the second electrical characteristic comprise a voltage.

11. The security system of claim 9, wherein the tamper threshold is adjustable.

12. The security system of claim 11, wherein the tamper threshold is adjustable based at least in part on at least one environmental factor.

* * * * *